US010076152B2

(12) United States Patent
Panian et al.

(10) Patent No.: US 10,076,152 B2
(45) Date of Patent: Sep. 18, 2018

(54) ARTICLE OF FOOTWEAR FOR ATHLETIC AND RECREATIONAL ACTIVITIES WITH BOOTIE

(71) Applicant: Nike, Inc., Beaverton, OR (US)

(72) Inventors: Nadia M. Panian, Beaverton, OR (US); Tobie D. Hatfield, Lake Oswego, OR (US); Elizabeth Langvin, Sherwood, OR (US)

(73) Assignee: NIKE, Inc., Beaverton, OR (US)

( * ) Notice: Subject to any disclaimer, the term of this patent is extended or adjusted under 35 U.S.C. 154(b) by 319 days.

(21) Appl. No.: 14/209,151

(22) Filed: Mar. 13, 2014

(65) Prior Publication Data

US 2015/0257476 A1 Sep. 17, 2015

(51) Int. Cl.

| | |
|---|---|
| ***A43B 13/22*** | (2006.01) |
| ***A43B 17/00*** | (2006.01) |
| ***A43B 19/00*** | (2006.01) |
| ***A43B 23/07*** | (2006.01) |
| ***A43B 5/00*** | (2006.01) |
| ***A43B 13/16*** | (2006.01) |
| ***A43B 23/02*** | (2006.01) |
| ***A43C 1/00*** | (2006.01) |

(52) U.S. Cl.

CPC ..... *A43B 5/00* (2013.01); *A43B 13/16* (2013.01); *A43B 13/22* (2013.01); *A43B 17/00* (2013.01); *A43B 19/00* (2013.01); *A43B 23/0235* (2013.01); *A43B 23/0265* (2013.01); *A43B 23/0295* (2013.01); *A43B 23/07* (2013.01); *A43C 1/00* (2013.01)

(58) Field of Classification Search

CPC ..... A43B 5/11; A43B 5/0405; A43B 5/1616; A43B 13/14; A43B 13/146; A43B 17/00; A43B 19/00; A43B 23/07; A43B 13/22

USPC ..... 36/114, 103, 31, 8.3, 55

See application file for complete search history.

(56) References Cited

U.S. PATENT DOCUMENTS

| | | | | |
|---|---|---|---|---|
| 3,327,410 A * | 6/1967 | Park, Sr. | ..... | A43B 5/00 24/442 |
| 5,544,430 A * | 8/1996 | Jacko | ..... | A43B 3/16 36/100 |
| 5,595,005 A * | 1/1997 | Throneburg | ..... | A41B 11/00 36/10 |
| 5,615,418 A | 4/1997 | Pruit | | |
| 5,951,935 A | 9/1999 | Healy et al. | | |

(Continued)

FOREIGN PATENT DOCUMENTS

| | | |
|---|---|---|
| DE | 296 13 422 U1 | 9/1996 |
| JP | 10-155504 A | 6/1998 |
| KR | 2002-0088326 A | 11/2002 |

*Primary Examiner* — Sharon M Prange

(74) *Attorney, Agent, or Firm* — Honigman Miller Schwartz and Cohn LLP; Matthew H. Szalach; Jonathan P. O'Brien

(57) ABSTRACT

An article of footwear with an inner bootie that fits into and is strapped into an external shell to form the article of footwear. The inner bootie may have specially-treated regions that together allow the bootie to slip readily into the external shell and to be held firmly in place. When the inner bootie is in place in the external shell, cable loops woven into the lateral side and the medial side of the inner bootie protrude from corresponding openings in the external shell. A lace may then be laced through the cable loops to fasten the throat opening of the external shell over a wearer's foot.

19 Claims, 13 Drawing Sheets

(56) References Cited

U.S. PATENT DOCUMENTS 7,131,219 B2 * 11/2006 Chen ..... A43B 7/20 36/50.1
7,325,336 B2 * 2/2008 Yamashita ..... A43B 5/00 36/102
7,370,442 B2 * 5/2008 Jung ..... A43B 7/1495 36/88
7,392,604 B2 7/2008 Greene et al.
7,434,336 B2 * 10/2008 Kosted ..... A43B 1/0081 36/10
7,490,417 B2 * 2/2009 Petrie ..... A43C 11/008 36/170
7,614,165 B2 11/2009 Curry
7,908,772 B2 3/2011 Celia
8,196,320 B2 6/2012 Adami et al.
2002/0078591 A1 * 6/2002 Morrone ..... A43B 5/12 36/8.3
2004/0128863 A1 7/2004 Hong et al.
2004/0244221 A1 12/2004 Hall et al.
2005/0115111 A1 * 6/2005 Yamashita ..... A43B 7/20 36/89
2005/0120463 A1 6/2005 Cacioppo
2006/0032090 A1 * 2/2006 Chen ..... A43B 3/26 36/58.5
2006/0080864 A1 * 4/2006 Chen ..... A43B 7/20 36/89
2007/0227037 A1 * 10/2007 Kao ..... A43B 3/106 36/10
2008/0172910 A1 * 7/2008 Dalla ..... A43B 7/082 36/3 B
2010/0154251 A1 * 6/2010 Nataadiningrat ..... A43B 5/12 36/8.3
2010/0293815 A1 * 11/2010 Ferrigan ..... A43B 3/0042 36/25 R
2012/0304493 A1 * 12/2012 Hudson ..... A43B 7/28 36/83
2012/0304498 A1 * 12/2012 Avar ..... A43B 3/242 36/132
2013/0031801 A1 2/2013 Hatfield et al.
2013/0263360 A1 * 10/2013 Thibodeau ..... A43B 7/14 2/239

* cited by examiner

ARTICLE OF FOOTWEAR FOR ATHLETIC AND RECREATIONAL ACTIVITIES WITH BOOTIE

This application is related to commonly owned U.S. Patent Application Publication Number 2015/0257475, filed on Mar. 13, 2014 and published on Sep. 17, 2015, and entitled "Article of Footwear for Athletic and Recreational Activities", which application is hereby incorporated by reference in its entirety.

BACKGROUND

The present embodiments relate generally to articles of footwear that may be used for contact sports such as wrestling.

Articles of footwear can generally be described as having two primary elements, an upper for enclosing the wearer's foot, and a sole structure attached to the upper. The upper generally extends over the toe and instep areas of the foot, along the medial and lateral sides of the foot and around the back of the heel. The sole structure may include an insole, a midsole, and an outsole. The insole is in close contact with the wearer's foot or sock, and provides a comfortable feel to the sole of the wearer's foot. The midsole generally attenuates impact or other stresses due to ground forces as the wearer is walking, running, jumping, or engaging in other activities. The outsole generally carries a tread pattern to ensure a firm contact with the ground or playing surface. For some activities, the outsole may also use cleats, spikes or other protrusions to engage the ground or playing surface and thus provide additional traction.

SUMMARY

This summary is intended to provide an overview of the subject matter of this patent, and is not intended to identify essential elements or key elements of the subject matter, nor is it intended to be used to determine the scope of the claimed embodiments. The proper scope of this patent may be ascertained from the claims set forth below in view of the detailed description below and the drawings.

In one aspect, an article of footwear includes an inner bootie and an external shell. The inner bootie has an ankle opening, a sole, a toe region and a forefoot region. The inner bootie also includes at least one cable loop woven into a lateral side of the inner bootie and at least one cable loop woven into the medial side of the inner bootie. The inner bootie has a perimeter region around at least one of the toe region and the forefoot region, where the perimeter region is configured to detachably attach itself to corresponding interior regions of the external shell. The inner bootie also has a region on a lower surface of the inner bootie that has a smooth surface. The article of footwear also includes an ankle strap attached to a heel region of the external shell that may be laced through slots on the lateral and medial sides of the ankle opening of the inner bootie. The external shell has a longitudinal throat opening and at least one opening on a lateral side of the longitudinal throat opening that corresponds to the at least one cable loop on the lateral side of the inner bootie. The external shell also has at least one opening on a medial side of the longitudinal throat opening that corresponds to the at least one cable loop on the medial side of the inner bootie.

In another aspect, an article of footwear includes an inner bootie with a toe region and a forefoot region. The article of footwear also includes a perimeter region at a perimeter of the toe region and at a perimeter of the forefoot region that is configured to releasably attach to a first adjoining interior surface of an external shell. The inner bootie further has a central region within the forefoot region of the inner bootie that has a surface with a low coefficient of friction with respect to a second adjoining interior surface of the external shell.

In another aspect, a wrestling shoe includes an inner bootie configured to fit into an external shell. The shoe also includes an ankle strap attached to a heel region of the external shell that may be laced through slots on the lateral and medial sides of an ankle opening of the inner bootie. The shoe further includes a perimeter region at a periphery of at least one of a forefoot region and a toe region of the inner bootie, where the perimeter region is configured to detachably attach itself to corresponding interior surfaces of the external shell when the inner bootie is inserted into the external shell.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

For clarity, the detailed descriptions herein describe certain exemplary embodiments, but the disclosure in this application may be applied to any article of footwear comprising certain of the features described herein and recited in the claims. In particular, although the following detailed description describes exemplary embodiments in the form of wrestling shoes, it should be understood that other embodiments may take the form of other articles of footwear, such as shoes for walking, running, jogging, water sports, gymnastics, volleyball or other athletic or recreational activities.

Figure 1:
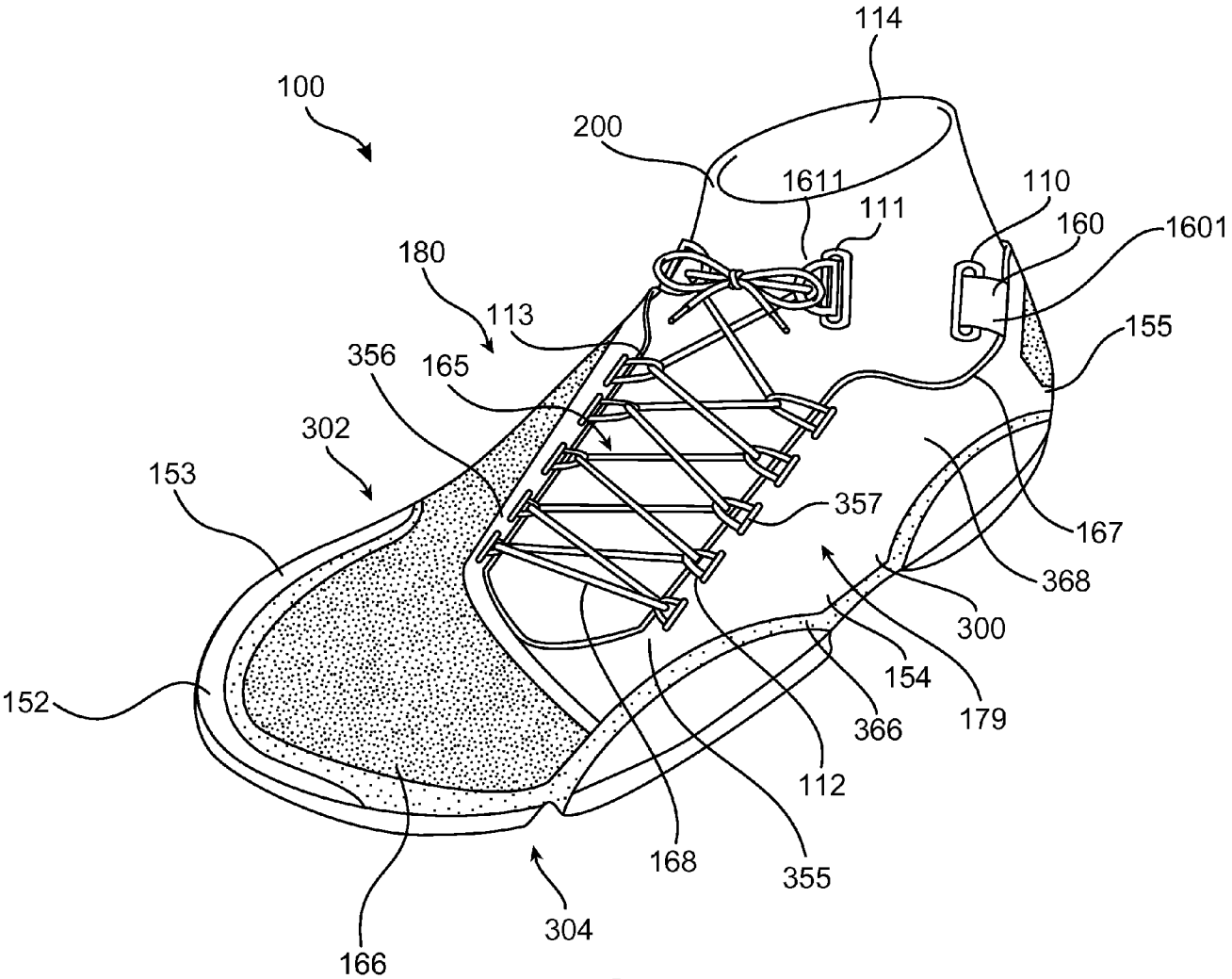
FIG. 1 is a schematic diagram of a perspective top side view of an embodiment of an article of footwear.

FIG. 1 is a front perspective view of an exemplary embodiment of an article of footwear 100. As shown in FIG. 1, this article of footwear 100 has two main components: an inner bootie 200 and an external shell 300. Inner bootie 200 fits into external shell 300. As described below, when inner bootie 200 is inserted into external shell 300, these two main components may be laced and strapped together to form the article of footwear 100 shown in FIG. 1.

Figure 2:
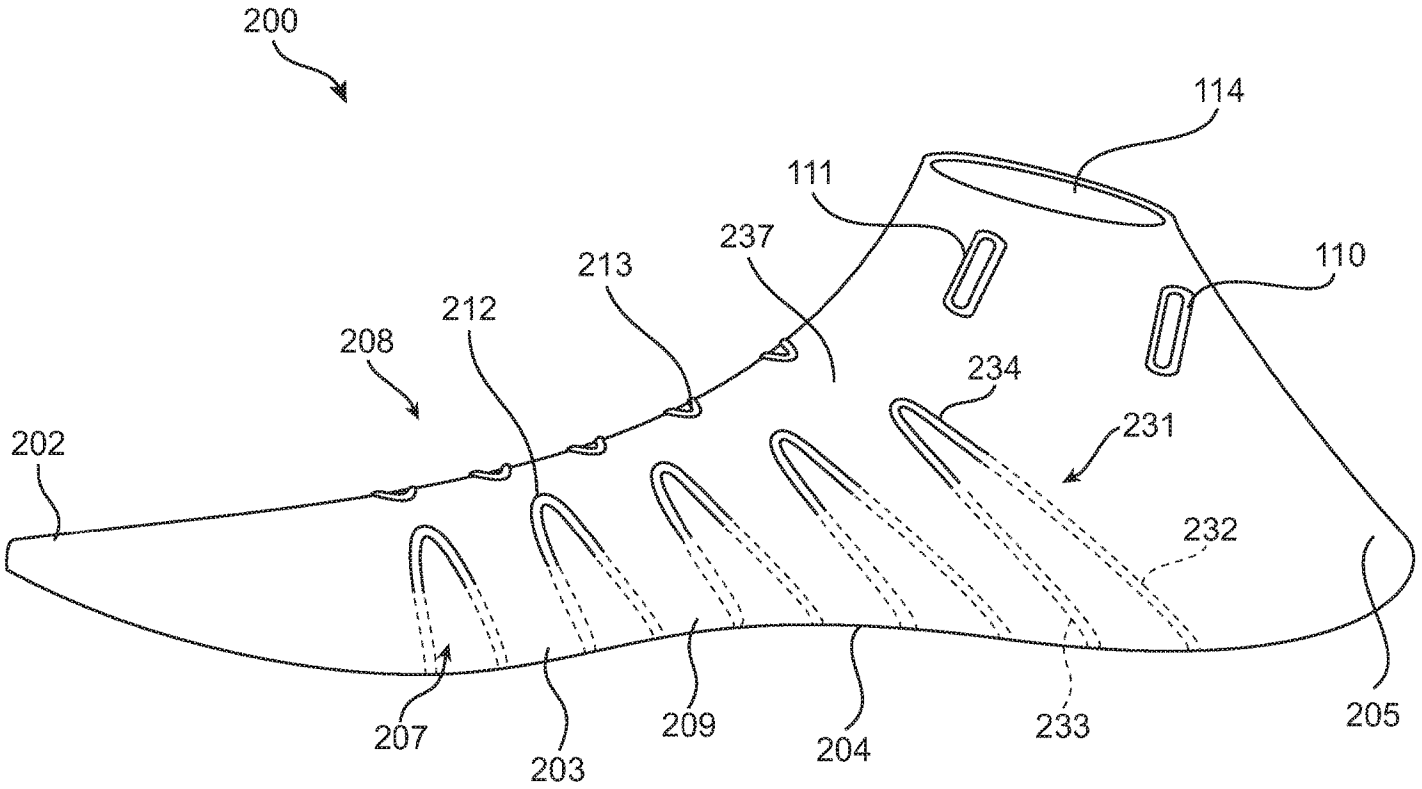
FIG. 2 is a schematic diagram of a lateral side view of an embodiment of an inner bootie.
Figure 3:
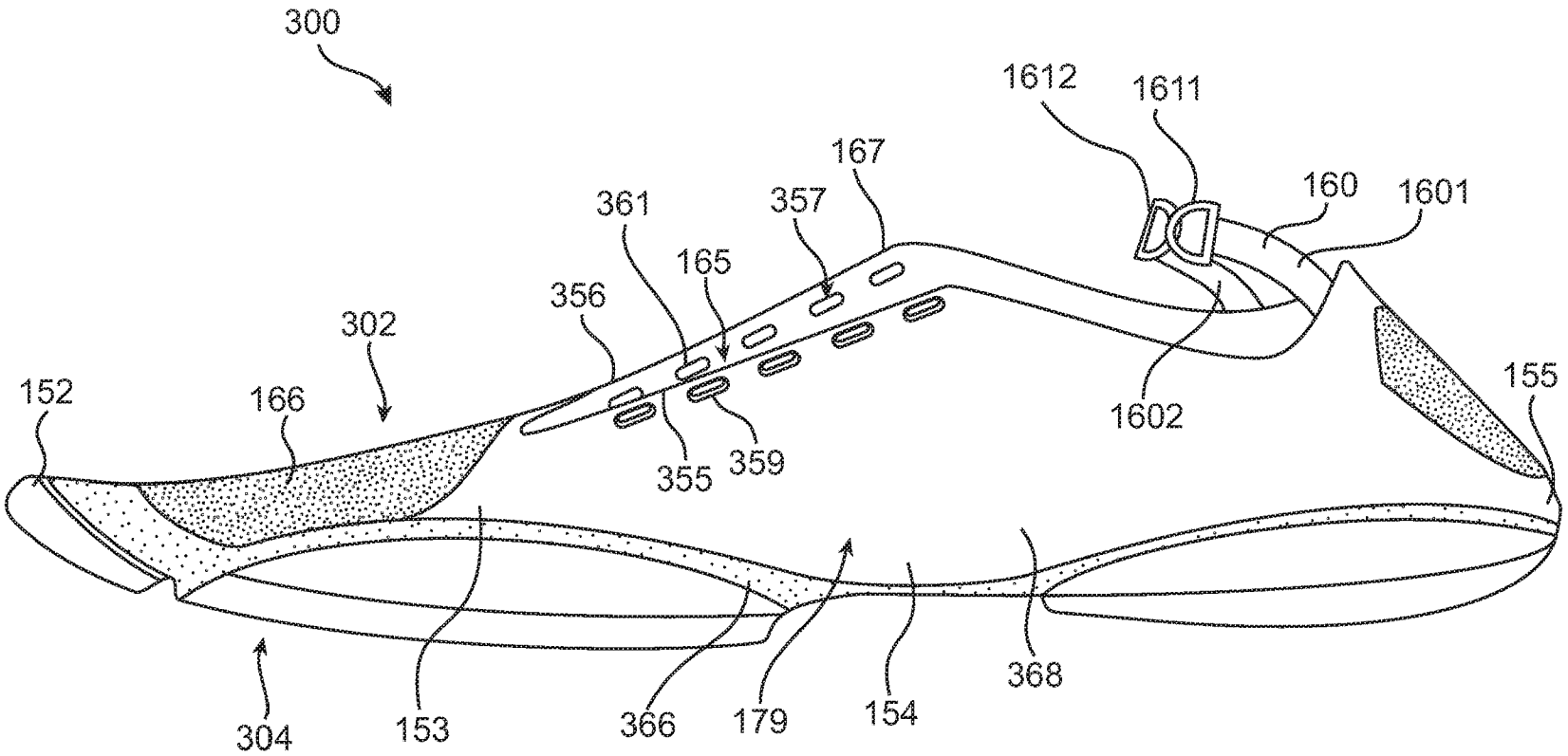
FIG. 3 is a schematic diagram of a lateral side view of an embodiment of an external shell.
Figure 4:
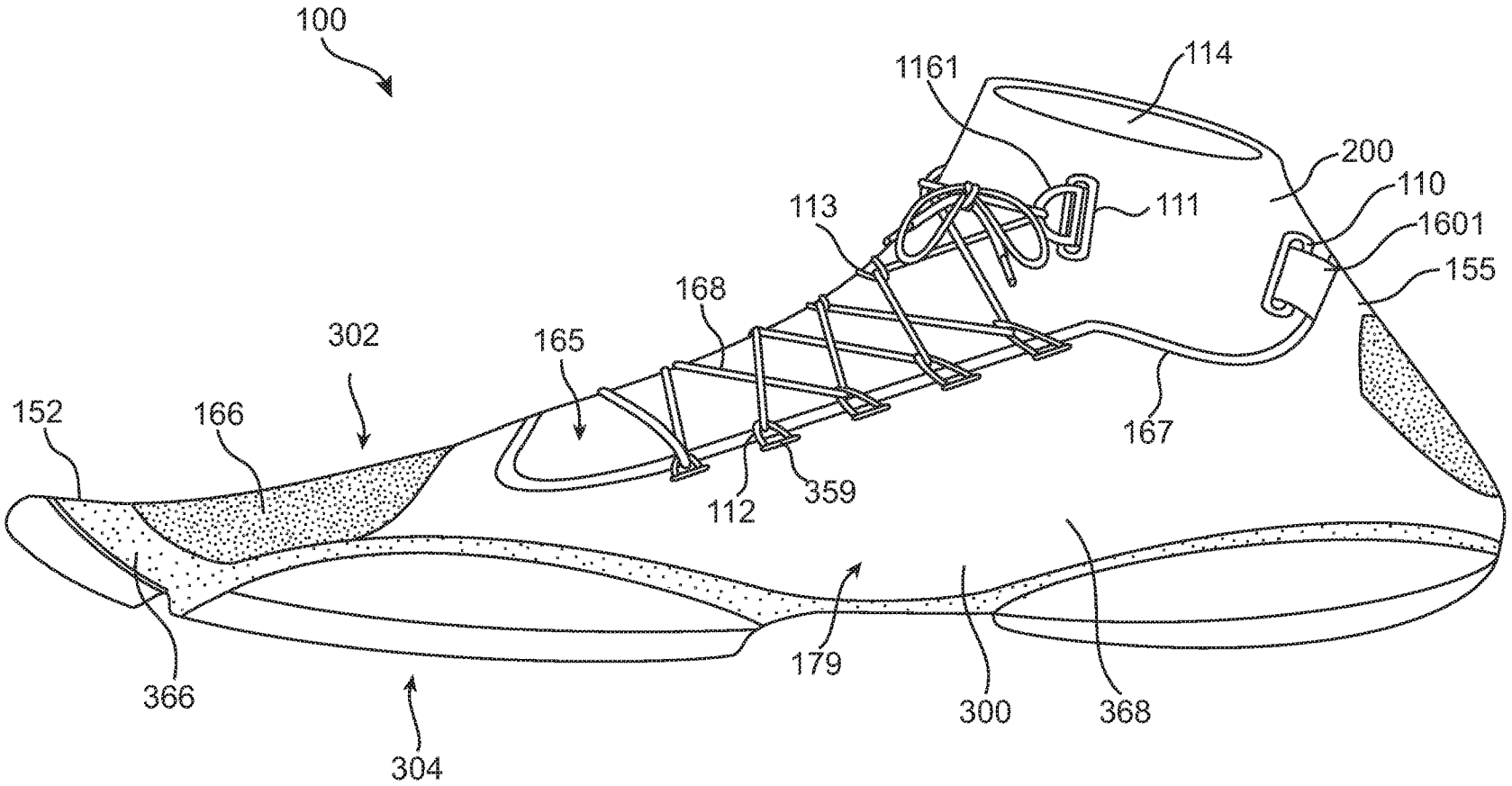
FIG. 4 is a schematic diagram of a lateral side view of an embodiment of an article of footwear in which an inner bootie is within an external shell.
Figure 5:
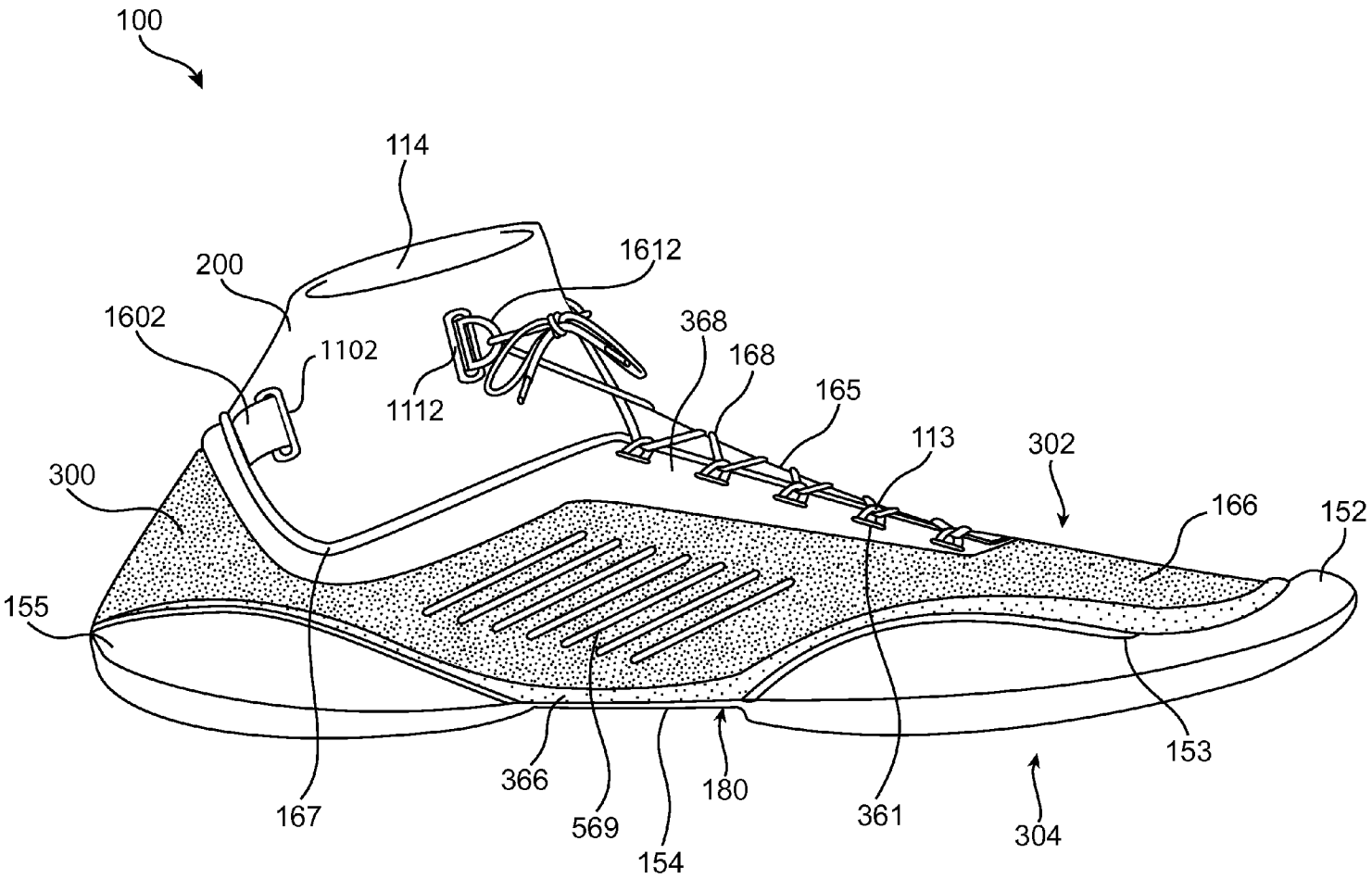
FIG. 5 is a schematic diagram of a medial side view of an embodiment of an article of footwear in which an inner bootie is within an external shell.

FIG. 2 illustrates a side view of an embodiment of inner bootie 200 in isolation from external shell 300. FIG. 3 illustrates a side view of an embodiment of external shell 300 without inner bootie inserted into external shell 300. It will be understood that in at least some embodiments, inner bootie 200 is intended to be easily removable from external shell 300. In still other embodiments, however, inner bootie 200 could be firmly attached to external shell 300 along at least some portions of inner bootie 200. FIG. 4 is a lateral side view of the article of footwear of FIG. 1, with the inner bootie 200 disposed within, and strapped into, outer shell 300. FIG. 5 is a medial side view of the combined article of footwear of FIG. 1.

As shown in FIGS. 1 and 3, external shell 300 has a toe region 152, a forefoot region 153, a midfoot region 154 and a heel region 155. In some embodiments, external shell 300 may also include a longitudinal throat opening region 165. An upper edge 167 of external shell 300 defines the perimeter of longitudinal throat opening 165, and curves around the back of external shell 300.

In some embodiments, external shell 300 includes one or more fasteners that may be used to secure article 100 around a foot. In some embodiments, external shell 300 may include one or more straps. In the embodiment depicted in FIGS. 1 and 3, external shell 300 includes a pair of ankle straps 160. Ankle straps 160 may comprise a lateral ankle strap 1601 and a medial ankle strap 1602 (see FIG. 3).

In at least some embodiments, ankle straps 160 may be configured to cooperate with other fastening provisions of article 100. In order to receive a lace or other fastener, some embodiments of ankle straps 160 can include fastener receiving portions at their ends. Fastener receiving portions may include, but are not limited to: rings (including D-rings), eyelets, slots, or any other kinds of fastener receiving portions. In the embodiment shown in FIGS. 1 and 3, lateral ankle strap 1601 includes a lateral-side ring 1611 and medial ankle strap 1602 includes a medial-side ring 1612.

In some embodiments, external shell 300 may include one or more openings disposed along fastening edges, which define the boundary of longitudinal throat opening 165. Specifically, external shell 300 may include openings adjacent to a lateral fastening edge 355 of longitudinal throat opening 165 on lateral side 179 of external shell 300. External shell may also include openings adjacent to a medial fastening edge 356 on medial side 180 of external shell 300.

As best shown in FIGS. 1 and 3, some embodiments of external shell 300 include a plurality of openings 357. In some embodiments, the plurality of openings 357 may be configured to receive a fastener, such as a lace, directly. In an exemplary embodiment, the plurality of openings 357 may be configured to receive cable loops, as described in detail below. As indicated in FIG. 3, plurality of openings 357 may further comprise lateral openings 359 and medial openings 361. Specifically, lateral openings 359 may be disposed adjacent to lateral fastening edge 355. Also, medial openings 361 may be disposed adjacent to medial fastening edge 356.

FIG. 2 is a schematic diagram of the lateral side of an embodiment of an inner bootie 200. As shown in FIG. 2, inner bootie 200 has a toe region 202, a forefoot region 203, a midfoot region 204 and a heel region 205.

In some embodiments, inner bootie 200 can include provisions to engage a fastener, such as a lace. As shown in FIG. 2, inner bootie 200 has lateral cable loops 212 woven into a lateral side 207 of inner bootie 200 and medial cable loops 213 woven into a medial side 208 of inner bootie 200. Lace 168 (shown in FIG. 1) may be laced through lateral cable loops 212 and medial cable loops 213 to integrate inner bootie 200 into external shell 300, and to close longitudinal throat opening 165, as explained below.

In some embodiments, each cable loop of lateral cable loops 212 and medial cable loops 213 may comprise a first portion, a second portion and an intermediate portion. For example, as best seen in FIG. 2, a cable loop 231 includes a first portion 232, a second portion 233 and an intermediate portion 234, where intermediate portion 234 is disposed between first portion 232 and second portion 233. In some embodiments, first portion 232 and second portion 233 both extend from a lower periphery 209 of bootie 200 up towards an instep portion 237 of bootie 200. In some embodiments, first portion 232 and second portion 233 are embedded within, or otherwise attached to, bootie 200. For example, first portion 232 and second portion 233 may be woven into bootie 200. Intermediate portion 234 may loop around between first portion 232 and second portion 233 in instep portion 237. Moreover, in some embodiments, intermediate portion 234 may be free of bootie 200, such that intermediate portion 234 can move independently of bootie 200.

As shown in FIGS. 1, 2 and 4, inner bootie 200 has an entrance slot 110 and an exit slot 111 for lateral side ankle strap 1601 on the lateral side of ankle opening 114. As shown in FIG. 5, inner bootie 200 also has an entrance slot 1102 and an exit slot 1112 slot on the medial side for the medial side ankle strap 1602 on the medial side of ankle opening 114.

Inner bootie 200 may be configured to slide readily into external shell 300. Once bootie 200 has been inserted into external shell 300, lateral side 1601 of ankle strap 160 and medial side 1602 of ankle strap 160 of external shell 300 may be inserted though corresponding openings in bootie 200. Specifically, as best shown in FIGS. 1 and 4, lateral side ankle strap 1601 may be inserted through entrance slot 110 and exit slot 111 of bootie 200. Additionally, as best shown in FIG. 5, medial side ankle strap 1602 may be inserted through entrance slot 1102 and exit slot 1112 of bootie 200. Lateral side ankle strap 1601 and medial side ankle strap 1602 may be further fastened using lace 168, as described below, or may be fastened using other fastening means, such as a separate lace, a buckle, buttons, hook-and-loop fasteners or other fastening means.

As shown in FIG. 4, when inner bootie 200 is inserted into external shell 300, lateral cable loops 112 are aligned with lateral openings 359 on lateral side 179 of external shell 300. Likewise, as shown in FIG. 5, medial cable loops 113 are aligned with medial openings 361 on medial side 180 of external shell 300. To further couple bootie 200 with external shell 300, lateral cable loops 112 may be pulled through lateral openings 359 (see FIG. 4) and medial cable loops 113 may be pulled through medial openings 361 in external shell 300 (see FIG. 5). A lace, such as lace 168, may then be passed through lateral cable loops 112 and medial cable loops 113 to fasten external shell 300 around the wearer's foot. This also fastens inner bootie 200 to external shell 300.

Lace 168 may be laced through lateral cable loops 112 and medial cable loops 113 protruding from openings 357 on the lateral and medial sides of external shell 300, respectively. If lace 168 is used to also fasten ankle strap 1601 and ankle strap 1602, lace 168 may then be laced through lateral-side ring 1611 of ankle strap 1601 and medial-side ring 1612 of ankle strap 1602, and tied into a bow to fasten the ankle straps around a wearer's ankle and to close longitudinal throat opening 165 over the wearer's foot.

Figure 6:
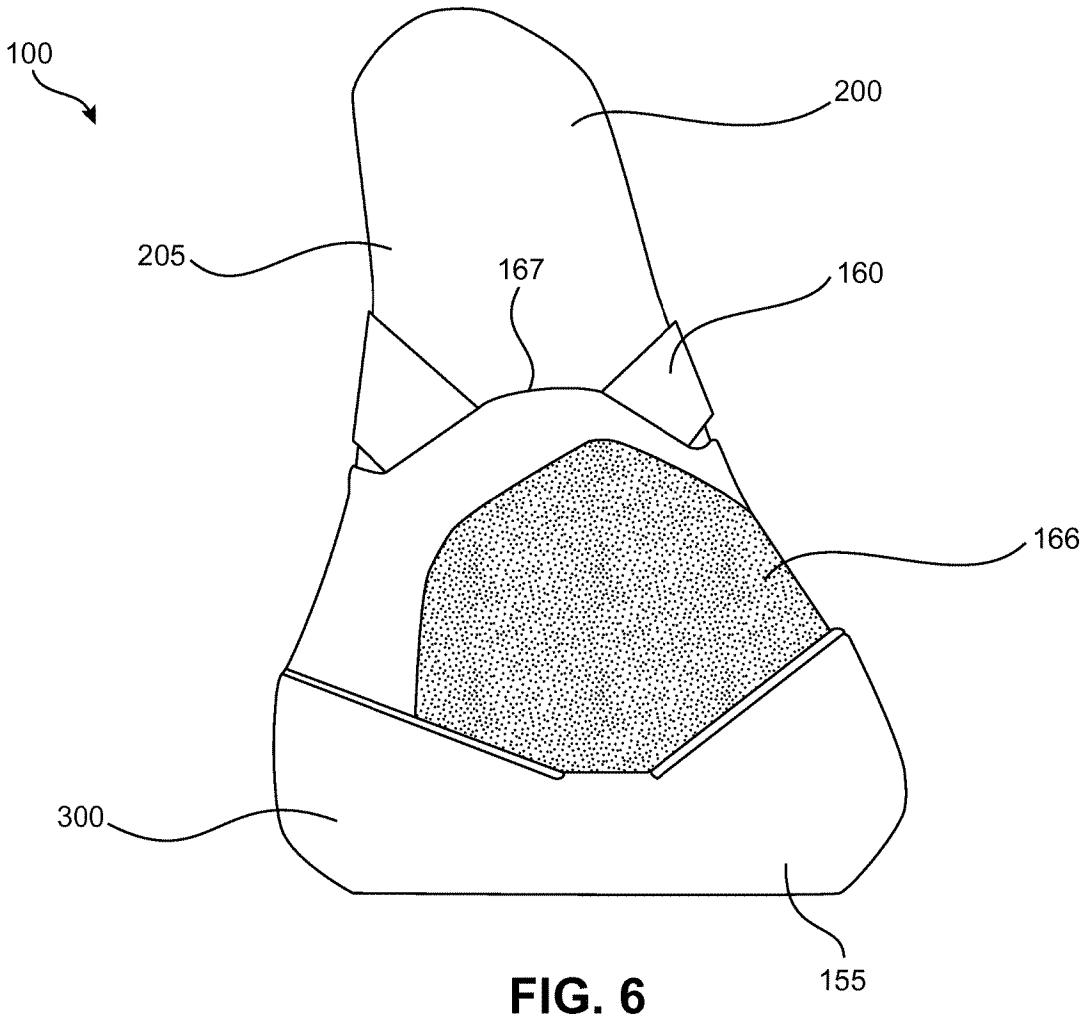
FIG. 6 is a schematic diagram of a rear view of an embodiment of an article of footwear in which an inner bootie is within an external shell.

FIG. 6 is a schematic diagram of the heel of the embodiment of FIG. 1, showing article of footwear 100 with inner bootie 200 in external shell 300. FIG. 6 shows ankle straps 160 attached to the back of heel region 155 and emerging from just above the upper edge 167 of external shell 300 to wrap around heel region 205 of inner bootie 200.

As seen in FIGS. 1-5, external shell 300 may be comprised of an upper portion 302 and a sole portion 304. Moreover, in at least some embodiments, upper portion 302 may be further comprised of one, two or more different portions, where each portion may have different material characteristics. Specifically, in the exemplary embodiment, upper portion 302 of external shell 300 comprises a base portion 368, along with a first overlay portion 166 and a second overlay portion 366.

Figure 7:
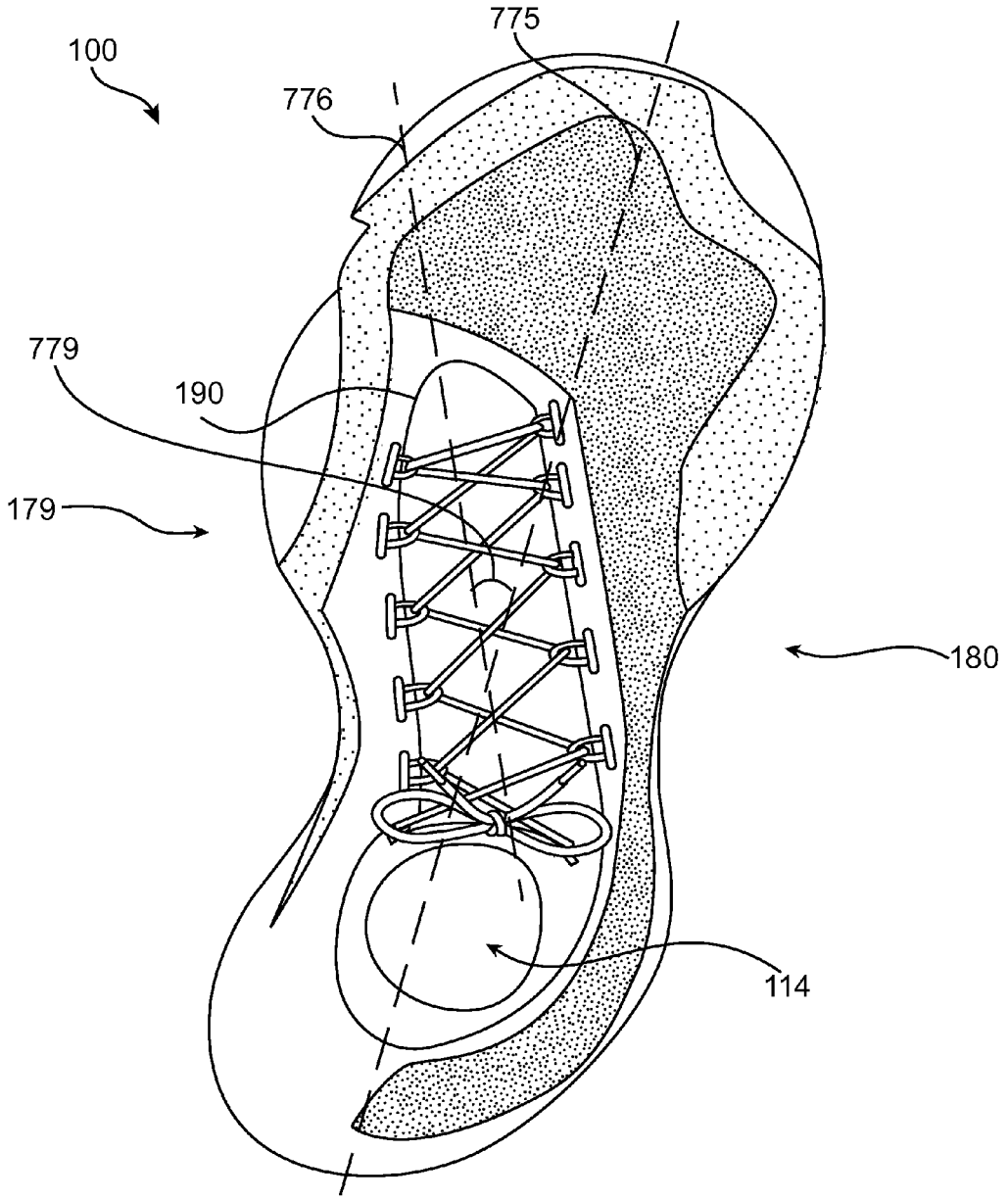
FIG. 7 is a schematic diagram of a top view of an embodiment of an article of footwear in which an inner bootie is within an external shell.

In some embodiments, base portion 368 may extend throughout the majority of external shell 300, though only some portions of base portion 368 may be visible on an exterior surface of external shell 300. For example, as best indicated in FIGS. 4 and 7, base portion 368 may be primarily visible on medial side 180 of external shell 300. In contrast, first overlay portion 166 and second overlay portion 366 may only be associated with some portions of upper portion 302. In particular, in some embodiments, first overlay portion 166 and second overlay portion 366 may be disposed over base portion 368. As seen in FIGS. 5 and 7, first overlay portion 166 extends primarily on medial side 180, extending through forefoot region 153, midfoot region 154 and heel region 155 of external shell 300. As best shown in FIGS. 4, 5 and 7, second overlay portion 366 may extend adjacent to sole portion 304 on medial side 180 and lateral side 179 of external shell 300.

In the embodiment shown in FIG. 3 and FIG. 4, first overlay portion 166 may be made of a first material, second overlay portion 366 may be made of a second material and base portion 368 may be made of a third material. In some embodiments, each of the first material, the second material and the third material could have different properties. For example, in some embodiments, the first material may have a lower coefficient of friction than the third material. Also, the second material may have a lower coefficient of friction than the third material. Thus, first overlay portion 166 and second overlay portion 366 may be substantially more slippery to the grip of an opponent than base portion 368.

In some embodiments, the material properties of the first material and the second material could vary from one another. In some embodiments, for example, the first material making up first overlay portion 166 could have a lower coefficient of friction than the second material making up second overlay portion 366. In other embodiments, first overlay portion 166 and second overlay portion 366 could have substantially similar coefficients of friction. By varying the coefficients of friction between first overlay portion 166 and second overlay portion 366, the frictional properties (e.g., the slipperiness) of different portions of external shell 300 can be varied to impede different ways that an opponent may attempt to grip article 100.

In some embodiments, external shell 300 may be made of flexible materials such that inner bootie 200 and external shell 300 can conform to each other when assembled, and provide a unitary flexible article of footwear. In some embodiments, in other words, the first material, the second material and the third material comprising first overlay portion 166, second overlay portion 366 and base portion 368 may each be made of flexible materials.

Some embodiments can include provisions to enhance the breathability of article 100, especially at portions comprised of materials that may include polymers or similar materials that might otherwise block airflow through portions of an upper. In at least some embodiments, as depicted in FIG. 5, first overlay portion 166 may include one or more slots 569. Slots 569 may be openings that allow moisture to escape, since the underlying base portion 368 may be more breathable than the material comprising first overlay portion 166.

Referring now to FIG. 7, in some embodiments, throat opening 165 may be biased towards one side of article 100. In some embodiments, throat opening 165 may be biased towards a medial side of article 100. In the embodiment depicted in FIG. 7, throat opening 165 may be biased towards a lateral side of article 100. Specifically, in the exemplary embodiment, throat opening 165 extends from the front of opening 114 towards lateral side 179 of external shell 300. Due to this bias of throat opening 165 away from the center of article 100, a forward end portion 190 of throat opening 165 may be disposed further from a central longitudinal axis 775 of article 100 than a rearward end portion of throat opening 165. As clearly shown by comparing FIGS. 2 and 3, a majority of throat opening 165 is associated with lateral side 179, while a much smaller portion of throat opening 165 is associated with medial side 180.

As clearly indicated in FIG. 7, a longitudinal axis 776 of throat opening 165 may form an angle 779 with respect to central longitudinal axis 775 of article 100. In different embodiments, the value of angle 779 could vary in a range between 0 degrees (i.e., no biasing) to 45 degrees, for example. In still other embodiments, angle 779 could be greater than 45 degrees. It is contemplated that some embodiments may utilize a configuration where throat opening 165 forms an angle approximately in the range between 5 degrees and 30 degrees.

While some embodiments may include a throat opening that may be approximately straight and biased towards lateral side 179, other embodiments could include throat openings that are curved or otherwise non-linear in their configuration. In some embodiments, different portions of throat opening 165 could vary in their angular orientation relative to, for example, central longitudinal axis 775.

Biasing the throat opening to the lateral side may have the effect of making it more difficult for an opponent to obtain a firm grasp on, for example, a wrestler's shoe. It is more difficult for an opposing wrestler to obtain a firm grasp on a shoe with a biased throat opening because the opponent's hand has to reach around the apex of the shoe and almost down to the lateral edge of the shoe so that his fingers can grasp the opposite side of the throat opening.

Figure 13:
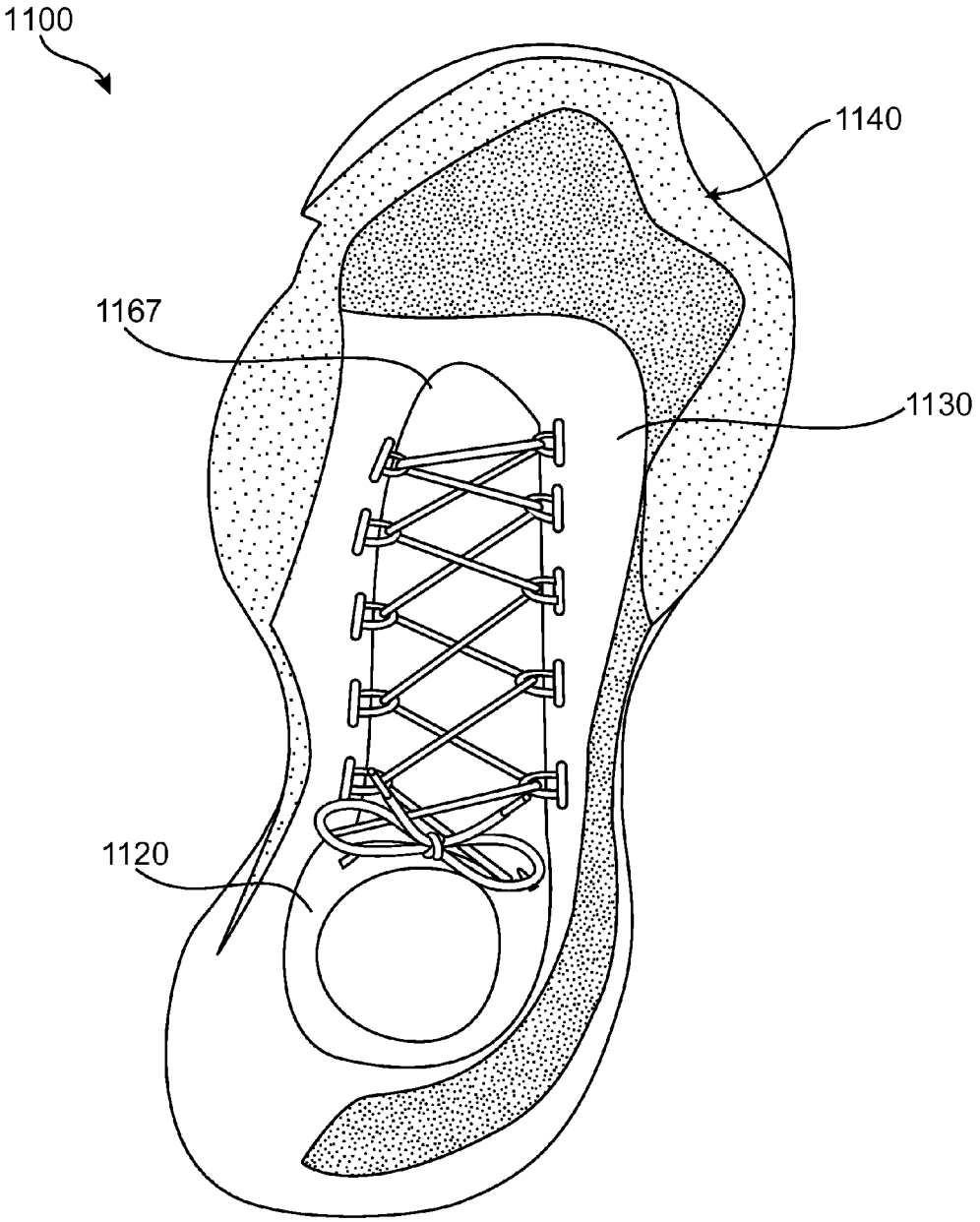
FIG. 13 is a schematic diagram of a top view of another embodiment of an article of footwear in which an inner bootie is within an external shell.

In some embodiments, a throat opening need not be biased towards a lateral (or medial) side of an article. In an alternative embodiment, depicted in FIG. 13, an article 1100 includes similar provisions to article 100 discussed above and shown in FIGS. 1-11. Article 1100 includes an external shell 1130 and an inner bootie 1120. In some embodiments, external shell 1130 may be provided with distinct material portions 1140 similar to the various material portions of article 100. However, the embodiment of article 1100 includes a generally straight throat opening 1167. In other words, throat opening 1167 may be approximately aligned with a central longitudinal axis of article 1100. Thus, article 1100 still provides a slippery surface for external shell 1130, but uses a more traditional lacing configuration, which may be preferable in some situations.

Figure 8:
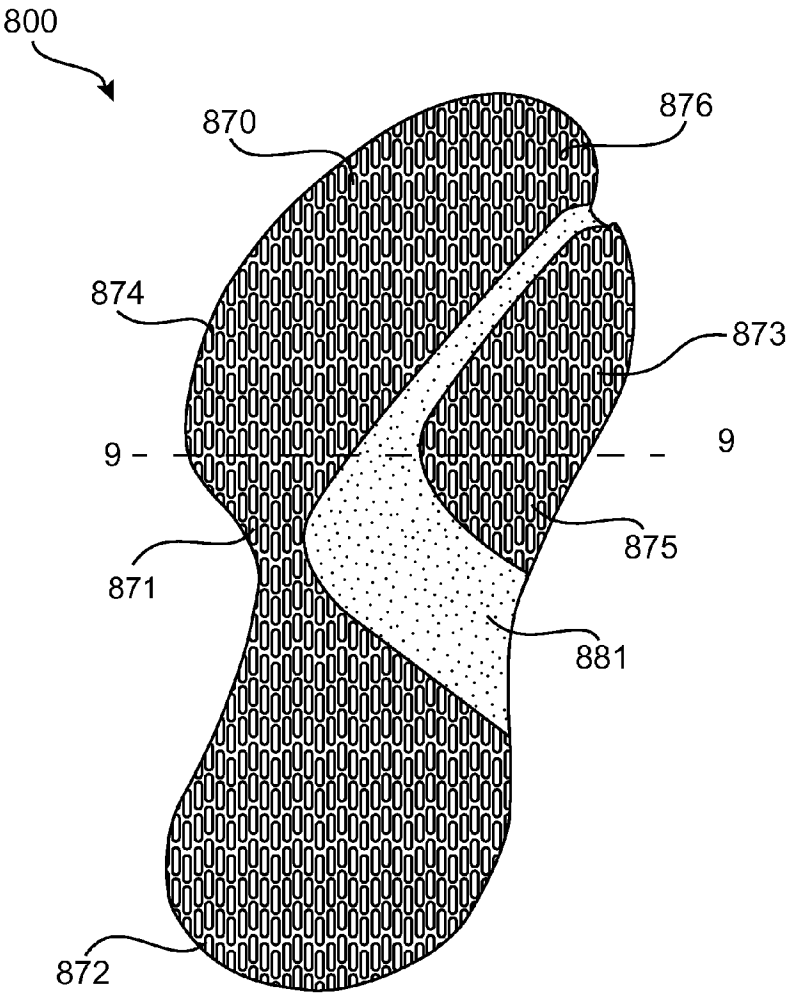
FIG. 8 is a schematic diagram of a bottom view of an embodiment of the sole of an external shell.
Figure 9:
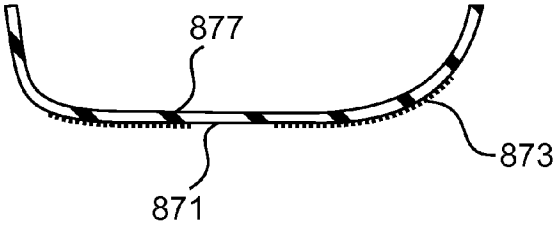
FIG. 9 is a schematic diagram of a cross-sectional view of an embodiment of a sole.

FIG. 8 is a bottom view of sole 800 of the external shell. FIG. 9 is a cross-sectional view of a portion of sole 800. Referring to FIGS. 8-9, sole 800 has a toe region 876, a forefoot region 870, a midfoot region 871 and a heel region 872. Sole 800 has a tread pattern 873 that covers most of sole 800 on a ground-facing surface that is opposite a foot-facing surface 877. Sole 800 may be made, for example, of a thin stretchable rubber sheet, on the order of 0.5 mm to 1.5 mm thick.

In some embodiments, sole 800 also has a tread-free zone 881. Tread-free zone 881 extends from a lateral side 874 of sole 800 towards the middle of the sole in the midfoot region 871, and then curves back to the lateral side of forefoot region 870. The tread-free zone 881 is also illustrated in the cross-section 880 of sole 800, as shown in FIG. 9. Tread free zone 881 imparts greater flexibility to sole 800, making heel region 872 flex readily with respect to toe region 876, as well as allowing flexing of the lateral side of forefoot region 870 with respect to a medial side 875 of forefoot region 870.

Inner bootie 200 may be made of a very malleable and flexible material, such as a spacer mesh. In some embodiments, inner bootie 200 may have a thin layer of thermoplastic urethane (TPU) in its forward perimeter regions, as described below with reference to FIGS. 10 and 11. The TPU layer may be somewhat tacky, such that the forward perimeter regions may grip or adhere to the adjoining interior surfaces of external shell 300, to help maintain inner bootie 200 in position within external shell 300.

Figure 10:
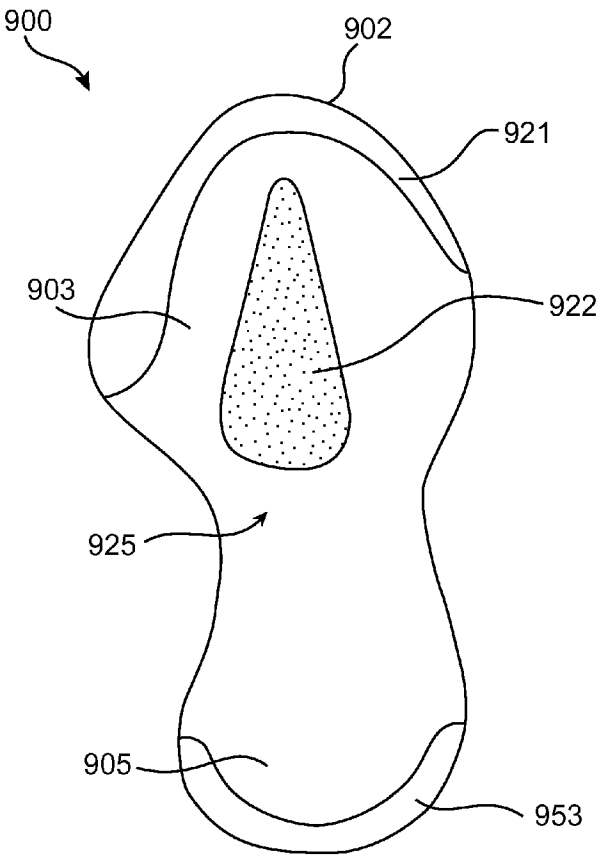
FIG. 10 is a schematic diagram of the bottom of an embodiment of inner bootie.

FIG. 10 is a schematic diagram of a bottom view of an embodiment of inner bootie 900. As shown in FIG. 10, inner bootie 900 has a toe region 902 and a forefoot region 903. Inner bootie 900 may also have a perimeter region 921 around the perimeter of the forefoot region 903 and the toe region 902. In some cases, perimeter region 921 may extend only on a lower surface of inner bootie 900. In other cases, perimeter region 921 may extend up onto a side surface of inner bootie 900. Inner bootie 900 may also have a perimeter region 953 around the perimeter of heel 905 of inner bootie 900. Perimeter region 953 may be disposed only on a lower surface of inner bootie 900, or may extend up onto an interior surface of the back of heel region 905 of inner bootie 900.

In some embodiments, perimeter region 921 and/or perimeter region 953 of bootie 900 may be associated with a material having a high coefficient of friction with respect to an interior surface of a corresponding external shell. In an exemplary embodiment, perimeter region may have been treated with TPU. In other embodiments, other materials or mechanisms may be used with perimeter region 921 and/or 953 such that the perimeter of the forefoot of inner bootie 900 grips or adheres to the adjoining parts of the interior of the external shell when the bootie is inserted into the external shell. In some embodiments, inner bootie 900 may also have a releasable and re-adhering adhesive in region 921 and/or region 953 that temporarily holds the forward part of inner bootie 900 in place in the external shell.

FIG. 10 also has a rounded generally triangular region 922 roughly in the middle of the forefoot region 903 on lower surface 925 of bootie 900. Region 922 may be made of a material that has a smooth and slippery surface. In other words, region 922 may have a relatively low coefficient of friction with respect to an internal surface of a corresponding external shell. This smooth surface allows the inner bootie to slip more easily into the external shell.

Figure 11:
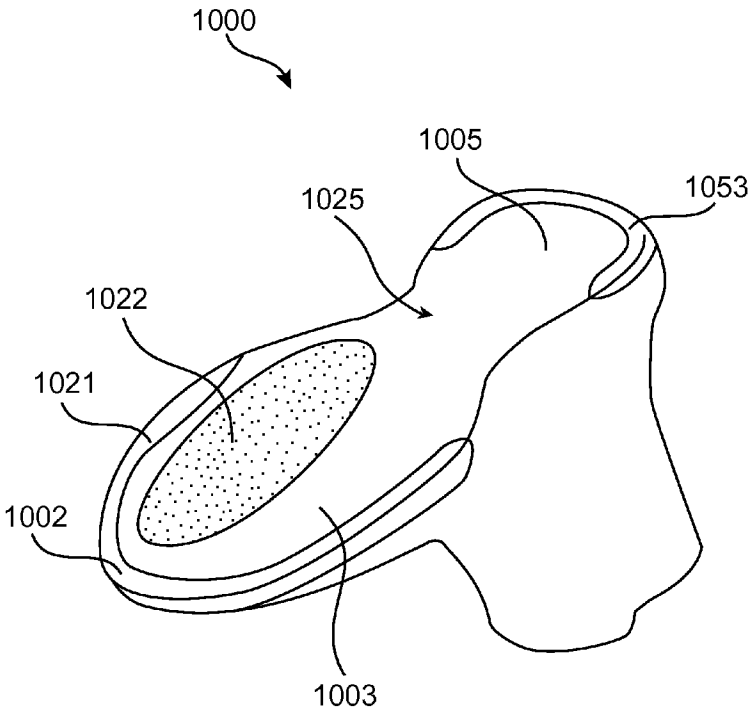
FIG. 11 is a schematic diagram of a perspective view of an embodiment of an inner bootie.

FIG. 11 is a schematic diagram of a perspective view of another embodiment of an inner bootie 1000, showing toe region 1002, forefoot region 1003 and heel region 1005. Inner bootie 1000 also has a lower surface 1025. Like the embodiment of FIG. 10, this embodiment has a perimeter region 1021 around the periphery of its forefoot region 1003 and its toe region 1002 and/or a perimeter region 1053 around its heel region 1005, so that the forward part and/or the heel part of the bootie may be temporarily held in place within the external shell. It also has a generally oval-shaped region 1022 on the bottom surface of the forefoot, which is made of a material with a smooth and slippery surface such that the inner bootie may more readily slip into the external shell.

As noted above, region 922 in the forefoot 903 of the inner bootie shown in FIG. 10 and region 1022 in the forefoot of the inner bootie shown in FIG. 11 are made of a material with a smooth surface, to allow the inner bootie to slip more easily into the external shell. Specifically, the coefficients of friction of the materials used in region 922 and region 1022 with respect to the interior surface of the external shell adjoining region 922 or region 1022 are low compared to the coefficient of friction of the material used in other regions of the inner bootie with respect to their adjoining interior surfaces of the external shell. The materials applied in region 922 or region 1022 may be overlaid onto the material of the bottom surface of the inner bootie, or may be sewn-in, glued-in, fused-in or welded in.

Figure 12:
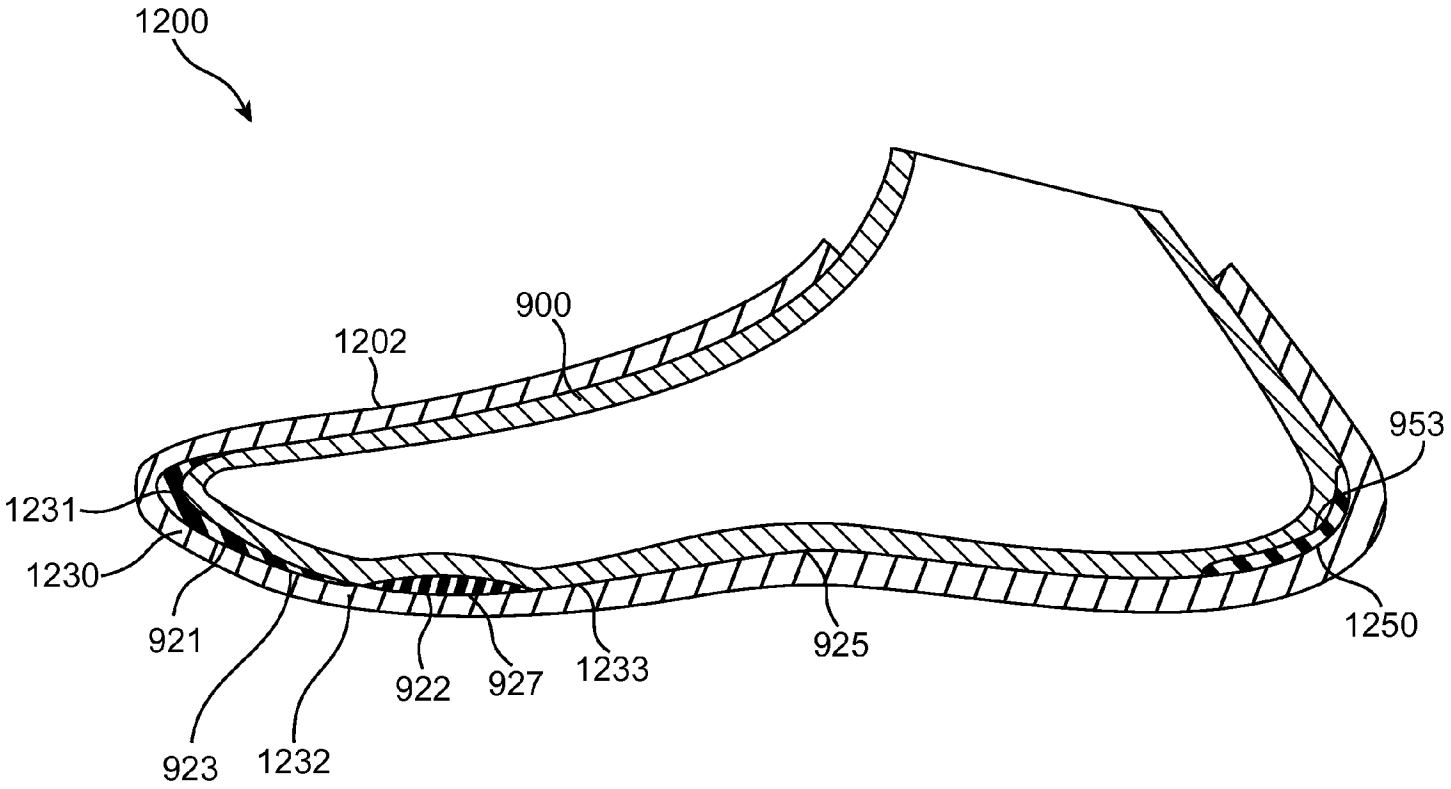
FIG. 12 is a schematic side cross-sectional view of an embodiment of an inner bootie inserted within an external shell.

FIG. 12 illustrates a side schematic cross-sectional view of an article 1200, with inner bootie 900 (shown in FIG. 10) inserted within an external shell 1202. As seen in FIG. 12, perimeter region 921 of inner bootie 900 is configured to contact an internal region 1230 on the forefoot of external shell 1202. Perimeter region 953 of inner bootie is configured to contact internal region 1250 in the heel of article 1200. In some embodiments, perimeter region 921 may detachably attach to portions of internal region 1230 and/or perimeter region 953 may detachably attach to portions of internal region 1250. In some cases, this temporary attachment may be created via frictional contact between perimeter region 921 and interior region 1230. Specifically, perimeter region 921 may have an outer surface 923 that has a relatively high coefficient of friction when contacting an adjoining surface 1231 of internal region 1230.

As also indicated in FIG. 12, region 922 of inner bootie 900 may contact an interior region 1232 of external shell 1202. To reduce any resistance to the initial insertion of inner bootie 900 into external shell 1202, region 922 may be configured to slide with respect to interior region 1232 of external shell 1202, which is a region engaging a lower surface 925 of inner bootie 900. Specifically, exterior surface 927 of region 922 has a low coefficient of friction when contacting adjoining surface 1233 of interior region 1232. This allows inner bootie 900 to easily slide into external shell 1202 until the point where perimeter region 921 may contact interior region 1230 of external shell 1202.

Figure 14:
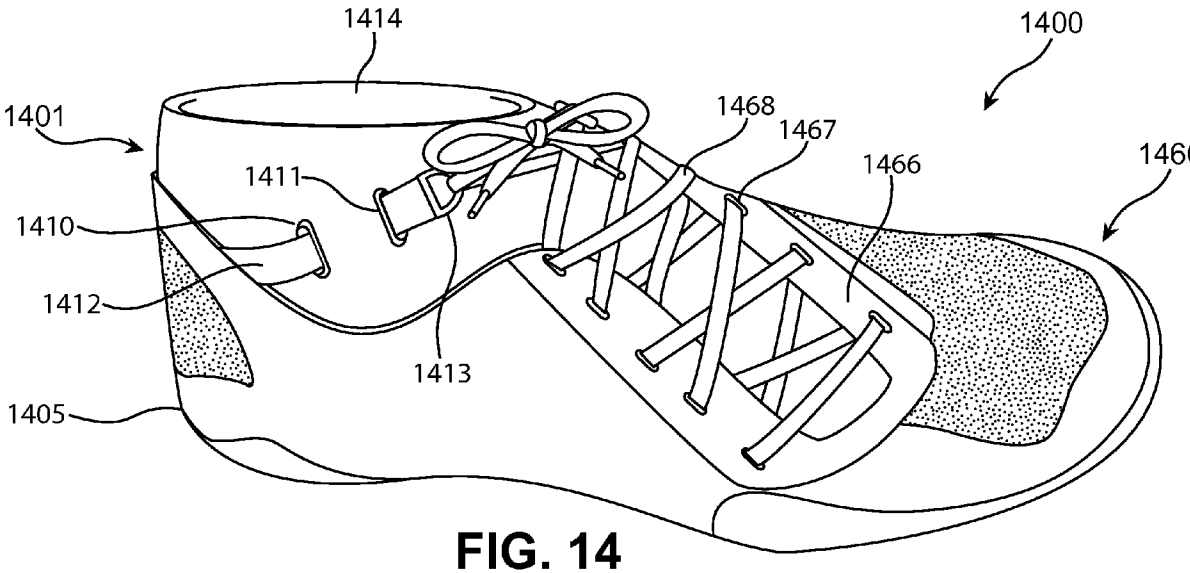
FIG. 14 is a schematic diagram of a side perspective view of another embodiment of an article of footwear in which an inner bootie is within an external shell.

Embodiments may also have inner booties with no cable loops, or with just one cable loop on either side of the inner bootie. For example, FIG. 14 is a schematic diagram of a perspective view of an embodiment of an article of footwear 1400 that does not have cable loops woven into the inner bootie. This embodiment is generally similar to the embodiment shown in FIGS. 1-7, for example, but does not include cable loops such as cable loops 212 and 213 shown in FIG. 2. In this embodiment, inner bootie 1401 fits within external shell 1460. Ankle straps 1412, attached to the interior of the heel 1405 of external shell 1460, are laced through entry slots 1410 and exit slots 1411 on the lateral and medial sides of ankle opening 1414 of inner bootie 1401. Lace 1468 is laced through slots 1467 in eyestay region 1466 of external shell 1460, then through rings 1413 at the ends of ankle strap 1412 to fasten inner bootie 1401 within external shell 1460, as well as to tighten eyestay region 1466 over a wearer's foot.

Figure 15:
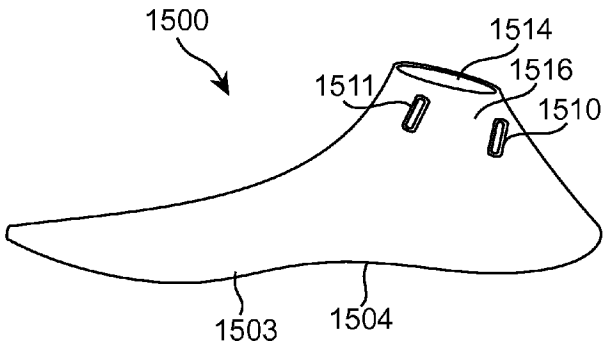
FIG. 15 is a schematic diagram of an embodiment of an inner bootie that may be used with the article of footwear shown in FIG. 14.

FIG. 15 is a schematic diagram of an inner bootie 1500 that may be used with the embodiment of FIG. 14. As shown in FIG. 15, inner bootie 1500 does not have any cable loops in its forefoot region 1503 or in its midfoot region 1504. It has an entry slot 1510 and an exit slot 1511 on the side of ankle region 1516. An ankle strap, such as ankle strap 1412 shown in FIG. 14 may be laced through entry slot 1510 and exit slot 1511 to fasten ankle opening 1514 of inner bootie 1500 around a wearer's ankle and to attach inner bootie 1500 to an external shell.

Figure 16:
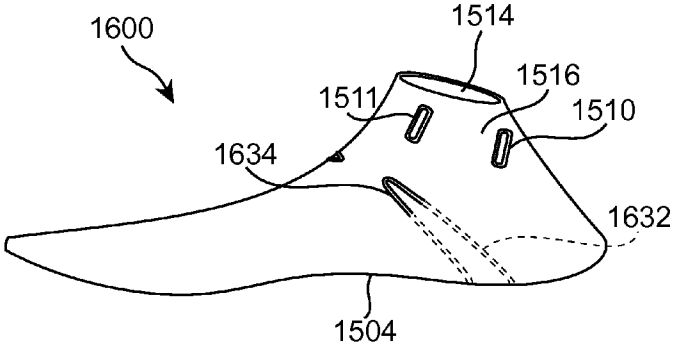
FIG. 16 is a schematic diagram of another embodiment of an inner bootie that may be used with an external shell.

FIG. 16 is a schematic diagram of an alternative embodiment of an inner bootie 1600, which has just one cable loop on the medial side of the inner bootie and one cable loop on the lateral side of the inner bootie. In this embodiment, the lower portion of cable loop 1632 is woven into the fabric of the inner bootie towards the rear of midfoot portion 1504 of the inner bootie. The top portion 1634 of cable loop 1632 can then be inserted through a corresponding opening in an external shell, such as openings 359 and 361 shown in FIG. 3. A lace, such as lace 1468 shown in FIG. 15, may then be laced through openings in an external shell such as openings 1467 shown in FIG. 14. The lace may then be laced through the top portion 1634 of cable loops 1632 and through end rings such as end rings 1413 shown in FIG. 14 to fasten the external shell around a wearer's foot and to attach the inner bootie to the external shell.

Figure 17:
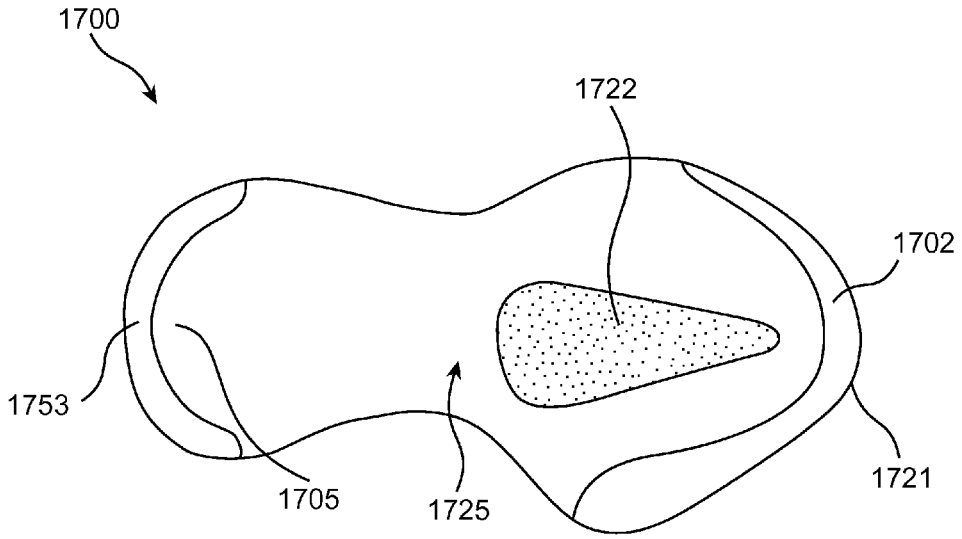
FIG. 17 is a schematic diagram of a strobel that may be used with the inner bootie shown schematically in FIG. 10.

In some embodiments, the strobel or upper surface of the bottom portion of the external shell may have portions corresponding to portions of the bottom of the inner bootie. For example, as shown in FIG. 17, a strobel 1700 of an external shell may have portions that correspond to the bottom of the inner bootie shown in FIG. 10. Thus, rounded generally triangular region 1722 on a top surface 1725 of strobel 1700 may match rounded generally triangular region 922 shown in FIG. 10. Region 1722, like region 922, may be made of a material that has a relatively low coefficient of friction. Region 1721 at the perimeter of the toe region 1702 of strobel 1700 may match corresponding region 921 at the perimeter of the toe region 902 of the inner bootie shown in FIG. 10. Region 1753 at the perimeter of the back of the heel region 1705 of strobel 1700 may match corresponding region 953 of the inner bootie shown in FIG. 10. Region 1721 and region 1753 may have a high coefficient of friction with respect to the materials used in corresponding regions of an inner bootie, such that these corresponding perimeter regions grip or adhere to each other when the inner bootie is fully inserted in to the external shell.

Some embodiments include provisions for improving flexibility and traction, particularly when the article of footwear contacts the ground at severe or irregular angles. In some cases, this may be accomplished by providing an outsole that is discontinuous in some way. This would allow adjacent outsole sections to flex more easily with respect to one another.

Figure 18:
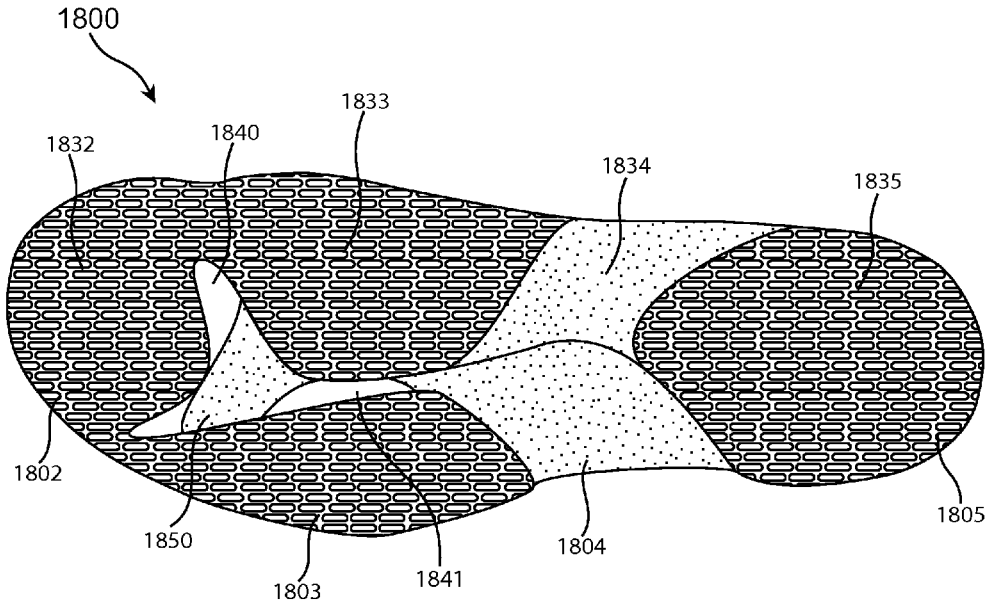
FIG. 18 is a schematic diagram of an embodiment of the bottom of the outsole of the external shell.

FIG. 18 is a schematic diagram of an alternative embodiment of an outsole 1800 of the external shell. In this embodiment, outsole 1800 provides enhanced traction at the heel region 1805, the forefoot region 1803 and the toe region 1802 of the external shell. Outsole 1800 may also provide a smooth surface 1834 in the midfoot region 1804 that would be more difficult for an opponent in a wrestling match, for example, to grip firmly. For example, outsole 1800 may have a tread pattern 1835 at its heel region 1805, and may also have a similar tread pattern 1833 in its forefoot region 1803 and a similar tread pattern 1832 its toe region 1802. It may alternatively have different tread patterns in its heel region, its forefoot region and/or its toe region.

In the embodiment shown schematically in FIG. 18, outsole 1800 has openings 1840 in the forefoot region 1803, which expose a lower layer 1841 (or rand) of the sole. Openings 1840 provide greater flexibility in the forefoot region of the article of footwear, allowing the footwear to flex longitudinally and/or laterally during an athletic or recreational activity. Tab 1850, which may have a smooth surface in this embodiment, is a thin, relatively flexible and supple material that protects the lower layer or rand, and does not significantly affect the ability of the forefoot region of the sole to flex.

The embodiments of the article of footwear shown in FIGS. 1-18, when used as a wrestling shoe, may provide significant advantages to a wrestler, because they are light and flexible, because the sole can flex, and because the inner bootie may be removed and washed after use.

In the embodiments described above, the inner bootie may be made of a lightweight flexible and soft material, such as a spacer mesh or a material that has similar properties. In some embodiments, the inner bootie may be made of a moisture-wicking material that wicks away perspiration from the wearer's foot. The external shell may also be made of a malleable and flexible material.

In the embodiments described above, the low coefficient of friction materials may be overlaid over the fabric of the upper, or may be separate materials sewn to, welded to, fused to, or adhesively attached to the breathable fabric of the upper. The overlays used in the embodiments described above may be made of thermoplastic elastomers such as thermoplastic polyurethanes.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear comprising:

an external shell having a forefoot region, a heel region, a midfoot region between the forefoot region and the heel region, and a toe region disposed forward of the forefoot region, wherein the external shell has:

a strobel including a foot-facing surface and a ground-facing surface opposite the foot-facing surface, wherein the foot-facing surface has:

a central region;

a perimeter surrounding the central region; and an attachment area disposed along the perimeter of the strobel;

an inner bootie designed to be inserted within the external shell, the inner bootie comprising a forefoot region, a heel region, a midfoot region disposed between the forefoot region and the heel region, and a toe region disposed forward of the forefoot region, wherein the inner bootie has:

a lower surface designed to contact the strobel of the external shell when the inner bootie is inserted within the external shell, wherein the lower surface has:

a central region corresponding with the central region of the strobel of the external shell, wherein the central region of the lower surface is designed to contact the central region of the strobel in a sliding manner;

a perimeter surrounding the central region of the lower surface; and an attachment area disposed along the perimeter of the lower surface, wherein the attachment area of the lower surface is made of a layer of material having a high coefficient of friction and has a width defined between a first edge and a second edge that is substantially parallel with the first edge to permit the attachment area of the lower surface to adhere to the attachment area of the strobel via a frictional contact between the attachment area of the lower surface and the attachment area of the strobel; and at least one ankle strap having a first end secured to the external shell and a second end laced through a first slot disposed in an ankle portion of the inner bootie extending outside the shell and through a second slot disposed in the ankle portion of the inner bootie extending outside the shell.

2. The article of footwear of claim 1, wherein the width of the attachment area follows an arcuate path along both the toe region and the forefoot region, wherein a portion of the lower surface that is located between the attachment area of the lower surface and the central region of the lower surface includes a first material, and wherein the layer of material of the attachment area of the lower surface is different from the first material.

3. The article of footwear of claim 2, wherein the central region includes a second material that is different from the layer of material of the attachment area of the lower surface and from the first material.

4. The article of footwear of claim 2, wherein the first material is a spacer mesh.

5. The article of footwear of claim 1, wherein the external shell has:

an outsole overlying the ground-facing surface of the strobel, the outsole having:

a tread pattern in the heel region and the forefoot region; and a smooth surface in the midfoot region that is smoother than the tread pattern, wherein the smooth surface is defined by a curved edge that corresponds with and is adjacent to a curved edge defining the tread pattern.

6. The article of footwear of claim 1, wherein the external shell has an outsole with a forefoot tread pattern at a forefoot region of the outsole, a heel tread pattern at a heel region of the outsole, and a tread-free region at a midfoot region of the outsole, and wherein portions of the outsole are spaced apart, such that there is a gap in the outsole that exposes a layer adjoining to the outsole.

7. A wrestling shoe comprising:

an external shell having a forefoot region, a heel region, a midfoot region between the forefoot region and the heel region, and a toe region disposed forward of the forefoot region, wherein the external shell has:

an upper edge defining a perimeter of a longitudinal throat opening, and curved around a back of the external shell;

a first ankle strap having a first end secured to and extending from the upper edge of a medial side of the external shell;

a strobel including a foot-facing surface and a ground-facing surface opposite the foot-facing surface, wherein the foot-facing surface has:

a central region;

a perimeter surrounding the central region;

a forward attachment area disposed in the toe region and the forefoot region along the perimeter of the strobel; and a rearward attachment area disposed in the heel region along the perimeter of the strobel;

an inner bootie designed to be inserted within the external shell, the inner bootie comprising a forefoot region, a heel region, a midfoot region disposed between the forefoot region and the heel region, and a toe region disposed forward of the forefoot region, wherein the inner bootie has:

a lower surface designed to contact the strobel of the external shell when the inner bootie is inserted within the external shell, wherein the lower surface has:

a central region corresponding with the central region of strobel of the external shell;

a perimeter surrounding the central region of the lower surface; and a forward attachment area disposed in both the toe region and the forefoot region along the perimeter of the lower surface, wherein the forward attachment area of the lower surface is designed to adhere to the forward attachment area of the strobel; and a rearward attachment area disposed in the heel region along the perimeter of the lower surface, wherein the rearward attachment area of the lower surface is designed to adhere to the rearward attachment area of the strobel, wherein a second end of the first ankle strap is laced through a first entrance slot disposed on a medial side of an ankle portion of the inner bootie extending outside the shell to and through a first exit slot disposed on the medial side of the ankle portion of the inner bootie extending outside the shell.

8. The wrestling shoe of claim 7, wherein the central region of the lower surface is designed to contact the central region of the strobel in a sliding manner and the central region of the lower surface has a lower coefficient of friction than the portions of the lower surface that are disposed between the forward attachment area of the lower surface, the rearward attachment area of the lower surface, and the central region of the lower surface.

9. The wrestling shoe of claim 7, wherein the external shell comprises an upper portion having a base portion and an overlay portion in its forefoot region, and wherein the overlay portion has a surface that is smoother than the base portion.

10. The wrestling shoe of claim 7, wherein the forward and rearward attachment areas of the lower surface include a layer of material having a width defined between a first edge and a second edge that is substantially parallel with the first edge and that permits the forward and rearward attachment areas of the lower surface to adhere to the forward and rearward attachment areas of the strobel, respectively, via a frictional contact between the forward and rearward attachment areas of the lower surface and the forward and rearward attachment areas of the strobel, respectively.

11. The wrestling shoe of claim 7, wherein the external shell has an outsole that comprises a forefoot tread pattern in its forefoot region and a heel tread pattern in its heel region, and further comprises a tread-free zone in its midfoot region.

12. The wrestling shoe of claim 11, wherein portions of the outsole in the forefoot region of the outsole are spaced apart, such that there is a gap in the outsole that exposes a layer adjoining to the outsole.

13. The wrestling shoe of claim 7, further comprising:

a second ankle strap secured to and extending from the upper edge of a lateral side of the external shell, wherein the second ankle strap is laced through a second entrance slot disposed on a lateral side of the ankle portion of the inner bootie extending outside the shell to and through a second exit slot disposed on the lateral side of the ankle portion of the inner bootie extending outside the shell.

14. An article of footwear comprising:

an external shell having a forefoot region, a heel region, a midfoot region between the forefoot region and the heel region, and a toe region disposed forward of the forefoot region, wherein the external shell has:

a strobel including a foot-facing surface and a ground-facing surface opposite the foot-facing surface, wherein the foot-facing surface has:

a central region;

a perimeter surrounding the central region;

a forward attachment area disposed in the toe region and the forefoot region along the perimeter of the strobel; and a rearward attachment area disposed in the heel region along the perimeter of the lower surface;

an inner bootie designed to be inserted within the external shell, the inner bootie comprising a forefoot region, a heel region, a midfoot region disposed between the forefoot region and the heel region, and a toe region disposed forward of the forefoot region, wherein the inner bootie has:

a lower surface designed to contact the strobel of the external shell when the inner bootie is inserted within the external shell, wherein the lower surface has:

a central region corresponding with the central region of strobel of the external shell, wherein the central region of the lower surface is designed to contact the central region of the strobel in a sliding manner;

a perimeter surrounding the central region of the lower surface;

a forward attachment area made of a material having a high coefficient of friction and including a first layer of material disposed in both the toe region and the forefoot region along the perimeter of the lower surface that permits the forward attachment area of the lower surface to adhere to the forward attachment area of the strobel via a frictional contact between the first layer of material and the forward attachment area of the strobel; and a rearward attachment area made of a material having a high coefficient of friction and including a second layer of material disposed in the heel region along the perimeter of the strobel that permits the rearward attachment area of the lower surface to adhere to the rearward attachment area of the strobel via a frictional contact between the second layer of material and the rearward attachment area of the strobel; and at least one ankle strap having a first end secured to the external shell and a second end laced through a first slot disposed in an ankle portion of the inner bootie extending outside the shell and through a second slot disposed in the ankle portion of the inner bootie extending outside the shell.

15. The article of footwear of claim 14, wherein the external shell includes:

an outsole overlying the ground-facing surface of the strobel, the outsole having:

a tread pattern in the heel region and the forefoot region; and a smooth surface in the midfoot region that is smoother than the tread pattern.

16. The article of footwear of claim 15, wherein the outsole has an opening in the forefoot region, which exposes a lower layer of the outsole.

17. The article of footwear of claim 16, wherein the outsole has a tab extending over the opening and connecting a first portion of the tread pattern to a second portion of the tread pattern in the forefoot region.

18. The article of footwear of claim 14, wherein the first layer of material of the forward attachment area of the lower surface has a width defined between a first edge and a second edge that is substantially parallel with the first edge, wherein the width of the forward attachment area follows an arcuate path along both the toe region and the forefoot region.

19. The article of footwear of claim 18, wherein the second layer of material of the rearward attachment area of the lower surface has a width defined between a third edge and a fourth edge that is substantially parallel with the third edge, wherein the width of the rearward attachment area follows an arcuate path along the heel region.

* * * * *